US006955165B2

(12) United States Patent
Liu

(10) Patent No.: US 6,955,165 B2
(45) Date of Patent: Oct. 18, 2005

(54) THREE-REENTRANCY COMBUSTION CHAMBER

(75) Inventor: Zhengbai Liu, Naperville, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 53 days.

(21) Appl. No.: 10/387,732

(22) Filed: Mar. 13, 2003

(65) Prior Publication Data

US 2004/0177828 A1 Sep. 16, 2004

(51) Int. Cl.[7] ..... F02B 23/00
(52) U.S. Cl. ..... 123/663; 123/193.6; 123/276
(58) Field of Search ..... 123/663, 664, 123/193.6, 276

(56) References Cited

U.S. PATENT DOCUMENTS 4,164,913 A 8/1979 Komiyama et al.
4,535,683 A 8/1985 Dworak et al.
4,721,080 A 1/1988 Moriyasu et al.
4,883,032 A 11/1989 Hunter et al.
5,029,563 A 7/1991 Hu
5,285,755 A 2/1994 Regueiro
5,560,334 A 10/1996 Daxer et al.
5,653,204 A 8/1997 Shaffer
5,660,156 A * 8/1997 Whitacre et al. ..... 123/279
5,809,962 A 9/1998 Abbott et al.
5,868,112 A 2/1999 Mahakul et al.
5,954,038 A 9/1999 Warwick et al.
5,979,298 A * 11/1999 Whitacre ..... 92/211
6,112,715 A 9/2000 Nigro et al.

* cited by examiner

*Primary Examiner*—Thomas Denion
*Assistant Examiner*—Zelalem Eshete
(74) *Attorney, Agent, or Firm*—Dennis Kelly Sullivan; Susan L. Lukasik; Jeffrey P. Calfa

(57) ABSTRACT

A combustion chamber assembly for use in a piston of a diesel engine includes a combustion chamber being defined intersecting a crown of the piston, the combustion chamber being substantially defined by three surfaces, a post being in part a spherical surface, a bottom and first side portion being an annular surface, and a second side portion being a taper surface, the combustion chamber having at least three reentrancies. A piston incorporating the combustion chamber assembly and a method of forming the combustion chamber are further included.

69 Claims, 2 Drawing Sheets

THREE-REENTRANCY COMBUSTION CHAMBER

TECHNICAL FIELD

The present invention relates to a piston designed for use in a compression ignition (diesel) internal combustion engine. More particularly, the present invention relates to a combustion chamber defined in part in a piston and intersecting the crown of the piston.

BACKGROUND OF THE INVENTION

Many attempts have been made to produce an ideal flow pattern for the charge of air and fuel within the combustion chamber of an internal combustion engine. Considerations that must be taken into effect include, but are not limited to, providing for adequate power generation, minimizing the $NO_x$ entrained in the engine exhaust, and minimizing the amount of soot particulate also entrained in the engine exhaust. These last two considerations should be accomplished without hurting the fuel economy of the engine and without adversely affecting the power output of the engine.

It is known that changes in any one of a variety of engine design/operating variables, such as engine compression, combustion chamber shape, fuel injection spray pattern, and other variables can have an effect on both emissions and power generated.

The amount of soot that is expelled with the engine's exhaust is unsightly and generates public pressure to clean up diesel engines. Further, the amount of soot that is entrained in the engine's lubrication oil can have a deleterious effect on engine reliability. Soot is very abrasive and can cause high engine wear.

There is additionally a great deal of pressure to reduce the $NO_x$ emissions from the engine. Ever increasing regulatory demands mandate reduced levels of $NO_x$. Typically, a combustion chamber design that is effective at reducing $NO_x$ levels has been found to increase the levels of soot and vice-versa. Additionally, doing either of the aforementioned typically reduces engine torque and power outputs.

There are numerous examples of combustion chambers formed in the crown of a piston. Notwithstanding all these prior art designs, there remains a need for reduction both in $NO_x$ and entrained soot while at the same time maintaining or enhancing engine torque and power outputs without adversely affecting the fuel economy of the engine.

SUMMARY OF THE INVENTION

The piston of the present invention substantially meets the aforementioned needs of the industry. The combustion chamber of the present invention defined intersecting the crown of the piston has been shown by substantiated simulation to greatly increase turbulence kinetic energy to the chamber and thereby to both reduce soot entrainment and $NO_x$ emissions. The piston has been shown to function effectively with cylinder heads having two or more valves. A further advantage of the piston of the present invention is that by being symmetrical with respect to a piston central axis, the combustion chamber is relatively more easily formed in the crown of the piston than known asymmetrical combustion chambers. The piston and combustion chamber of the present invention are preferably used in heavy-duty and medium-duty diesel engines.

The present invention is a combustion chamber assembly for use in a piston of a diesel engine and includes a combustion chamber being defined intersecting a crown of the piston, the combustion chamber being substantially defined by three surfaces, a post being in part a spherical surface, a bottom and first side portion being an annular surface, and a second side portion being a taper surface, the combustion chamber having at least three reentrancies.

The present invention is further a piston incorporating the combustion chamber assembly and a method of forming a combustion chamber.

DETAILED DESCRIPTION OF THE DRAWINGS

Figure 1:
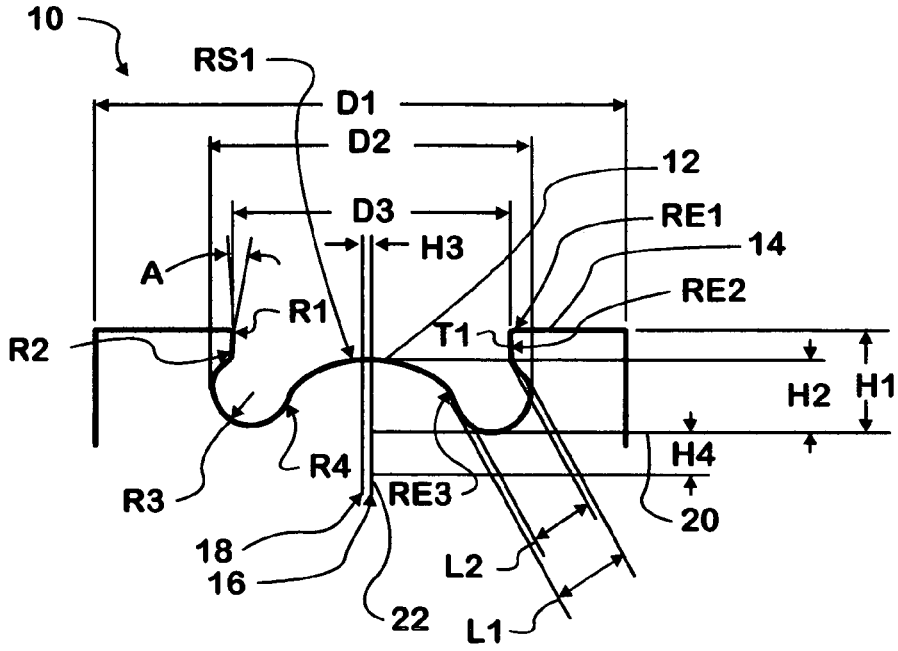
FIG. 1 is a sectional view of the piston and combustion chamber of the present invention.

The piston of the present invention is shown generally at 10 in FIG. 1. Generally, the piston 10 has a centrally located, symmetrical, upward-opening chamber bowl for forming an assembly being a three-reentrancy combustion chamber 12, formed in cooperation with cylinder structure within a cylinder of a diesel engine. A reentrancy is defined as structure that projects into the combustion chamber volume. The reentrancies each define a ring centered on the center axis of the combustion chamber having a radius that is less than adjacent chamber bowl structure. In FIG. 1, it is noted that, for example, reentrancy RE2 and the annular surface R2 (both described in greater detail below) appear to define the same structure. In fact, RE2 is the portion of the annular surface R2 that projects into the combustion chamber volume.

The combustion chamber 12 is defined intersecting the top surface or crown 14 of the piston 10. The engine has a fuel injector (not shown) disposed generally above the piston 10 for forming an injected fuel plume relative to the combustion chamber 12. The piston 10 may be utilized with two-valve or multiple-valve heads. The piston 10 is effective for reducing diesel engine pollutant emissions, such as NOx and soot, as depicted in the graphic representations of FIGS. 2 and 3. The piston 10 is preferably applicable to heavy-duty and medium duty diesel engines.

The piston 10 has a symmetrical upwardly opening cavity or bowl for forming a major part of the combustion chamber 12 within a cylinder of a diesel engine. The combustion chamber 12 is located intersecting the piston crown 14 of diesel engines. The combustion chamber 12 of the present invention is used primarily for heavy-duty and medium-duty diesel engines, but is not necessarily restricted to such uses.

The combustion chamber 12 comprises a bowl bottom portion and a bowl side portion defined by an assembly of three major surfaces. A spherical surface (RS1) with a radius RS1 forms the central part or post of the combustion chamber 12 bottom portion. An annular surface (R3) with a radius of R3 defines the outside margin of the combustion chamber 12 bottom portion and the lower part of the combustion chamber 12 side portion. A taper surface T1, having an angle of A, forms the upper part of the combustion chamber 12 side portion. The taper surface T1 is preferably a section of a cone. The angle A is defined between the taper surface T1 and a line parallel to the combustion chamber central axis 16. As noted in FIG. 1, the origin of the cone from which the taper surface T1 is formed is located above the combustion chamber 12.

Three relatively smaller annular surfaces R1, R2 and R4 are used as transition surfaces. Annular surface R1 makes a smooth transition between the upper margin of the taper surface of the combustion chamber 12 and the piston top surface 14. The annular surface R2 connects the lower margin of the taper surface T1 to the annular surface R3. The third annular surface, R4, connects the annular surface R3 to the spherical surface RS1. All the above-noted transitions between surfaces are smoothly effected by the annular surfaces R1, R2 and R4.

There are three reentrant components in the combustion chamber 12. RE1, noted above, is the first reentrancy and is formed by the top margin of the taper surface T1. RE2 is the second reentrancy and is formed by a partial side section of the annual surface R3 proximate a first end of the annular surface R3. RE3 is the third reentrancy and is formed by a partial bottom section of the annular surface R3, proximate a second end of the annular surface R3. Note that the distance from the top margin of the taper surface T1 to the bowl axis is smaller than that from the bottom margin of the taper surface, so that the top margin of taper surface T1 forms the reentrancy RE1. Similarly, the distance L2 is smaller than the distance L1 (the distances L1, L2 are defined below). On both sides of L2, there are two reentrant parts of RE2 and RE3, compared with two measurements points of L1.

As depicted in FIG. 1, the spherical surface RS1 is located on the center axis 16 of the combustion chamber 12. By definition in FIG. 1, D1 is the piston diameter, D2 is the maximum bowl diameter, D3 is the bowl lip diameter, H1 is the bowl depth, H2 is the height of the bowl post, H3 is the distance between the combustion chamber axis 16 and the piston axis 18, and H4 is the distance between the origin 22 of the spherical surface RS1 and the point of intersection of the combustion chamber axis 16 with the bottom plane 20 of the combustion chamber 12. Definitionally, the length L1 is the diameter of the annular surface R3 and the length L2 is the distance between the reentrancy RE2 and the reentrancy RE3.

The origin of the spherical surface RS1 is located on the central axis 16 of the combustion chamber 12. The distance H4 is preferably equal to or greater than zero and is more preferably less than 0.35 D1. Most preferably, the distance H4 is 0.105 D1.

The central axis 16 of the combustion chamber 12 may be coincident with the central axis 18 of the piston 10 or may have an offset therefrom. The offset, distance H3, between the central axis 16 of the combustion chamber 12 and the central axis 18 of the piston 10 is equal to or greater than zero and is preferably less than 0.08 D1. The distance H3 is most preferably zero such that the two axes 16, 18 are coincident.

The angle A between the taper surface T1 and the combustion chamber axis 16 defines the conical shape of taper surface T1 and is greater than zero and less 25 degrees. The angle A is preferably 10 degrees.

The ratio of L2 to L1 is preferably greater than 0.55 and less than 0.99. The ratio of L2 to L1 is most preferably 0.882.

The following relationships of parameters control the geometry of the combustion chamber 12 and defines the performance of the combustion chamber 12 and emissions therefrom in diesel engines.

1. The ratio of D2/D1 is greater than 0.44 and less than 0.88 and is most preferably 0.596.
2. The ratio of D3/D2 is greater than 0.33 and less than 0.99 and is most preferably 0.859.
3. The ratio of RS1/D2 is greater than 0.11 and less than 0.59 and is preferably 0.392.
4. The ratio of H1/D2 is greater than 0.21 and less than 0.55 and is most preferably 0.315.
5. The ratio of H2/D2 is greater than 0.11 and less than 0.46 and is preferably 0.216.
6. The ratio of R1/D2 is greater than 0.01 and less than 0.17 and is most preferably 0.027.
7. The ratio of R2/D2 is greater than 0.01 and less than 0.15 and is most preferably 0.025.
8. The ratio of R3/D2 is greater than 0.05 and less than 0.34 and is most preferably 0.124.
9. The ratio of R4/D2 is greater than 0.01 and less than 0.09 and is most preferably 0.018.

The curved surfaces and smooth transitions (junctures between adjacent surfaces) of the combustion chamber 12 as previously described promote smooth flow in the combustion chamber 12 and act to reduce the thermal loading in the combustion chamber 12. Further, the combustion chamber 12 is preferably symmetrical about both the chamber axis 16 and the piston axis 18. Accordingly, it is much easier to turn (form) the combustion chamber 12 in the crown 14 of the piston 10 as compared to an asymmetrical combustion chamber defined in a piston.

Figure 2:
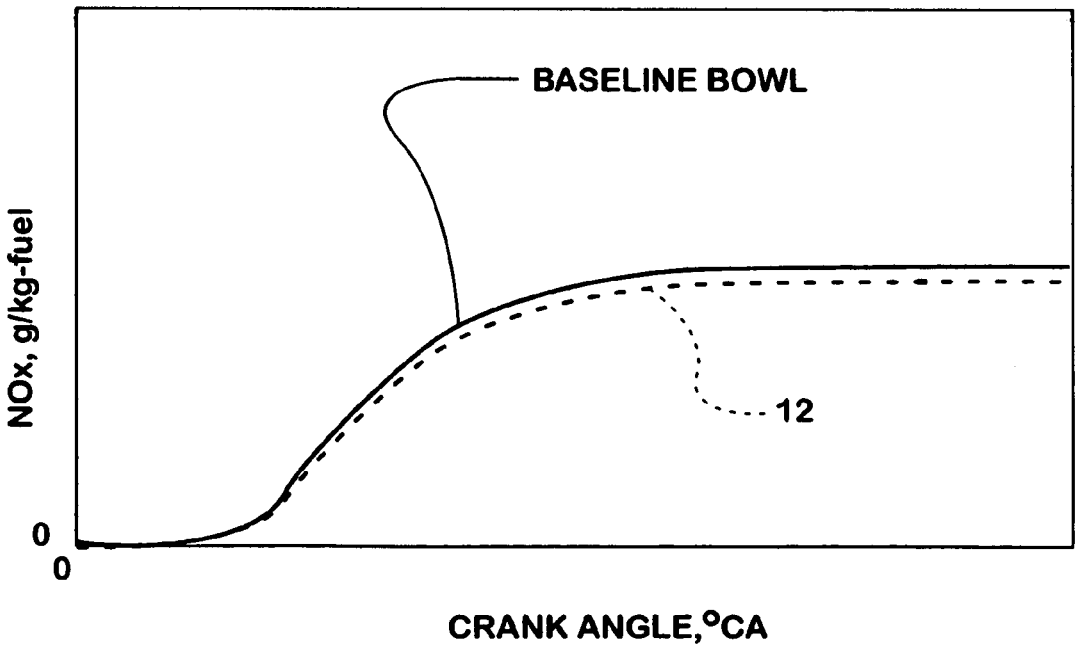
FIG. 2 is a graphic representation of simulation data of a prior art chamber bowl of $NO_x$ generated with respect to crank angle, noted as bowl baseline, and a simulation of $NO_x$ generated by an engine with pistons and combustion chambers of the present invention, noted as new bowl.

FIG. 2 displays a comparison of $NO_x$ emissions between the prior art baseline combustion chamber and combustion chamber 12, noted as new bowl. It is evident that the $NO_x$ emissions in the three-reentrancy combustion chamber 12 of the present invention are reduced significantly, compared with the baseline combustion chamber.

Figure 3:
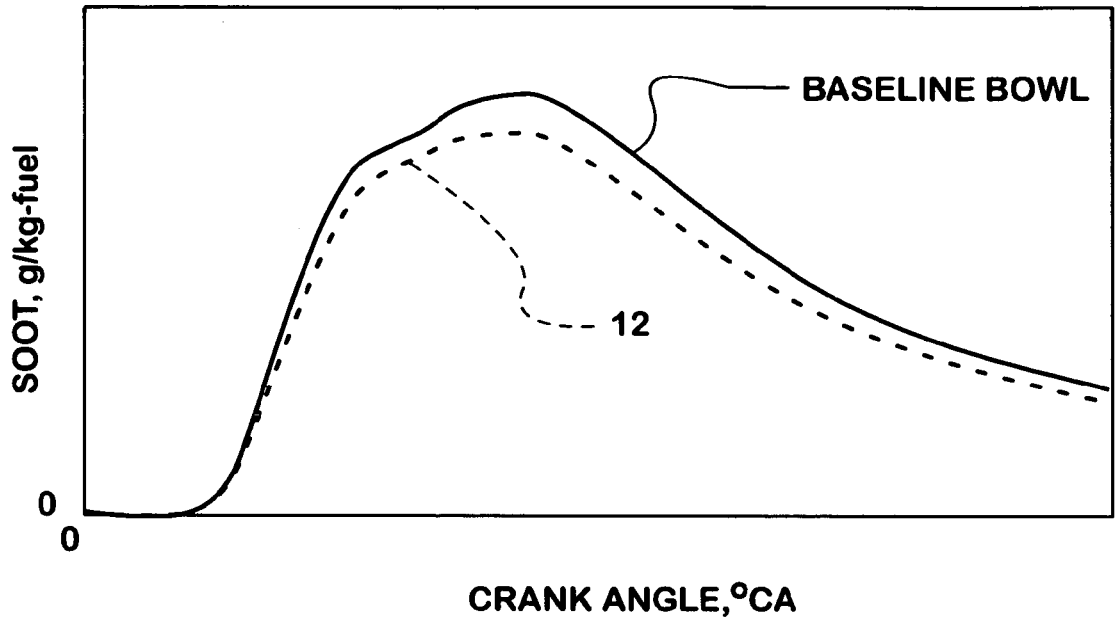
FIG. 3 is a graphic representation of the soot generated by the prior art chamber bowl of FIG. 2 as compared to the combustion chamber of the present invention, noted as new bowl.

FIG. 3 presents a comparison of soot emissions between two types of combustion chambers. It is clear that the soot emissions in the combustion chamber 12 (noted as new bowl) are much lower than those in the baseline combustion chamber.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A combustion chamber assembly for use in a piston of a diesel engine, comprising:

a combustion chamber being defined intersecting a crown of the piston, the combustion chamber being substantially defined by three surfaces, the three surfaces including a post being at least in part a spherical surface, a bottom and first side portion being an annular surface, and a second side portion being a tapered surface, the combustion chamber having a rounded edge intersecting the crown and at least three reentrancies, a reentrancy being a structural ring centered on a center axis of the combustion chamber having a radius that is less than adjacent chamber structure.

2. The combustion chamber assembly of claim 1, the combustion post being at least in part a portion of a convex sphere, the spherical surface having a radius and an origin, the origin of the spherical surface lying on a combustion chamber central axis;

the annular surface being concave and having an origin and a radius and being operatively coupled to the post; and the tapered surface being joined at a first end to the annular surface and being transitioned to the crown of the piston.

3. The combustion chamber assembly of claim 2 wherein the center axis of the combustion chamber is coaxial with a center axis of the piston.

4. The combustion chamber assembly of claim 1 wherein a first reentrancy is disposed at an upper margin of the tapered surface, a second reentrancy transitions the tapered surface to the annular surface and a third reentrancy transitions the annular surface to the spherical post.

5. The combustion chamber assembly of claim 1 wherein the combustion chamber is symmetrical about a combustion chamber axis.

6. The combustion chamber assembly of claim 1 wherein a distance H4 between the origin of the spherical surface RS1 and a point of intersection of the combustion chamber axis and the bottom plane of the combustion chamber is equal to or greater than zero and less than 0.35 D1, D1 being the piston diameter.

7. The combustion chamber assembly of claim 6 wherein the distance H4 between the origin of the spherical surface RS1 and the point of intersection of the combustion chamber axis and the bottom plane of the combustion chamber is substantially 0.105 D1.

8. The combustion chamber assembly of claim 2 wherein a distance H3 between the central axis of the combustion chamber and a central axis of the piston is equal to or greater than zero and less than 0.08 D1, D1 being the piston diameter.

9. The combustion chamber assembly of claim 8 wherein the distance H3 is preferably zero.

10. The combustion chamber assembly of claim 2 wherein an included angle between the tapered surface and the central axis of the combustion chamber is greater than zero and less than 25 degrees.

11. The combustion chamber assembly of claim 10 wherein the included angle between the tapered surface and the central axis of the combustion chamber is substantially 10 degrees.

12. The combustion chamber assembly of claim 2 wherein the ratio of a dimension L2, the distance between the reentrancy RE2 and the reentrancy RE3, to a dimension L1, the diameter of the annular surface R3, is greater than 0.55 and less than 0.99.

13. The combustion chamber assembly of claim 12 wherein the ratio of the dimension L2, the distance between the reentrancy RE2 and the reentrancy RE3, to the dimension L1, the diameter of the annular surface R3, is substantially 0.882.

14. The combustion chamber assembly of claim 2 wherein the ratio of a combustion chamber bowl diameter D2 to a piston diameter D1 is greater than 0.44 and less than 0.88.

15. The combustion chamber assembly of claim 14 wherein the ratio of the combustion chamber bowl diameter D2 to the piston diameter D1 is preferably substantially 0.596.

16. The combustion chamber assembly of claim 2 wherein the ratio of a diameter of the bowl lip D3 to a maximum combustion chamber diameter D2 is greater than 0.33 and less than 0.99.

17. The combustion chamber assembly of claim 16 wherein the ratio of the diameter of the bowl lip D3 to the maximum combustion chamber diameter D2 is substantially 0.859.

18. The combustion chamber assembly of claim 2 wherein the ratio of an annular surface R1 to a maximum diameter of the bowl D2 is less than 0.17.

19. The combustion chamber assembly of claim 18 wherein the ratio of the annular surface R1 to the maximum diameter of the bowl D2 is substantially 0.027.

20. The combustion chamber assembly of claim 2 wherein the ratio of an annular surface R2 to a maximum diameter of the bowl D2 is between 0.01 and 0.15.

21. The combustion chamber assembly of claim 20 wherein the ratio of the annular surface R2 to the maximum diameter of the bowl D2 is substantially 0.025.

22. The combustion chamber assembly of claim 2 wherein the ratio of a bowl depth H1 to a maximum bowl diameter D2 is between 0.21 and 0.55.

23. The combustion chamber assembly of claim 22 wherein the ratio of the bowl depth H1 to the maximum bowl diameter D2 is preferably substantially 0.315.

24. The combustion chamber assembly of claim 2 wherein a ratio of a height of the bowl post H2 to a maximum bowl diameter D2 is between 0.11 and 0.46.

25. The combustion chamber assembly of claim 18 wherein the ratio of the bowl post height H2 to the maximum bowl diameter D2 is preferably substantially 0.216.

26. The combustion chamber assembly of claim 2 wherein a ratio of the radius of the spherical surface RS1 to a maximum bowl diameter D2 is between 0.11 and 0.59.

27. The combustion chamber assembly of claim 26 wherein the ratio of the radius of the spherical surface RS1 to the maximum bowl diameter D2 is preferably substantially 0.392.

28. The combustion chamber assembly of claim 2 wherein the ratio of the radius of an annular surface R3 to a maximum bowl diameter D2 is between 0.05 and 0.34.

29. The combustion chamber assembly of claim 28 wherein the ratio of the radius of the annular surface R3 to the maximum bowl diameter D2 is preferably substantially 0.124.

30. The combustion chamber assembly of claim 2 wherein the ratio of a radius of an annular surface R4 to a maximum bowl diameter D2 is between 0.01 and 0.09.

31. The combustion chamber assembly of claim 30 wherein the ratio of the radius of the annular surface R4 to the maximum bowl diameter D2 is preferably substantially 0.018.

32. The combustion chamber assembly of claim 1 the combustion chamber having a central axis, the combustion chamber central axis being coincident with a piston central axis.

33. A piston of a diesel engine having a combustion chamber assembly, comprising:

a combustion chamber being defined intersecting a crown of the piston, the combustion chamber being substantially defined by three surfaces, the three surfaces including a post being at least in part a spherical surface, a bottom and first side portion being an annular surface, and a second side portion being a tapered surface the combustion chamber having a rounded edge intersecting the crown and at least three reentrancies, a reentrancy being a structural ring centered on a center axis of the combustion chamber having a radius that is less than adjacent chamber structure.

34. The piston of claim 33, a combustion chamber first curved surface being a center portion, a center portion being defined at least in part by a surface being a portion of a convex sphere to define the post, the sphere having a radius and an origin, the origin of the sphere lying on a combustion chamber central axis;

the annular surface being concave and having an origin and a radius and being joined to the post; and the tapered surface being joined at a first end to the annular surface and being transitioned to the crown of the piston.

35. The piston of claim 34 wherein the center axis of the combustion chamber is coaxial with a center axis of the piston.

36. The piston of claim 33 wherein a first reentrancy is at the upper margin of the tapered surface, a second reentrancy transitions the tapered surface to the annular surface and a third reentrancy transitions the annular surface to the spherical post.

37. The piston of claim 33 wherein the combustion chamber is symmetrical about a combustion chamber axis.

38. The piston of claim 33 wherein a distance H4 between the origin of the spherical surface RS1 and a point of intersection of the combustion chamber axis and a bottom plane of the combustion chamber is equal to or greater than zero and less than 0.35 D1, the piston diameter.

39. The piston of claim 38 wherein the distance H4 between the origin of the spherical surface RS1 and the point of intersection of the combustion chamber axis and the bottom plane of the combustion chamber is substantially 0.105 D1.

40. The piston of claim 34 wherein a distance H3 between the central axis of the combustion chamber and a central axis of the piston is equal to or greater than zero and less than 0.08 D1, D1 being the piston diameter.

41. The piston of claim 40 wherein the distance H3 between the central axis of the combustion chamber and the central axis of the piston is preferably zero.

42. The piston of claim 34 wherein an included angle between the tapered surface and the central axis of the combustion chamber is greater than zero and less than 25 degrees.

43. The piston of claim 42 wherein the included angle between the tapered surface and the central axis of the combustion chamber is substantially 10 degrees.

44. The piston of claim 34 wherein the ratio of a dimension L2, the distance between a reentrancy RE2 and a reentrancy RE3, to a dimension L1, the diameter of the annular surface R3, is greater than 0.55 and less than 0.99.

45. The piston of claim 44 wherein the ratio of the dimension L2, the distance between the reentrancy RE2 and the reentrancy RE3, to the dimension L1, the diameter of the annular surface R3, is substantially 0.882.

46. The piston of claim 34 wherein the ratio of a combustion chamber bowl diameter D2 to a piston diameter D1 is greater than 0.44 and less than 0.88.

47. The piston of claim 46 wherein the ratio of the combustion chamber bowl diameter D2 to the piston diameter D1 is preferably substantially 0.596.

48. The piston of claim 34 wherein the ratio of a diameter of a bowl lip D3 to a maximum combustion chamber diameter D2 is greater than 0.33 and less than 0.99.

49. The piston of claim 48 wherein the ratio of the diameter of the bowl lip D3 to the maximum combustion chamber diameter D2 is substantially 0.859.

50. The piston of claim 34 wherein the ratio of an annular surface R1 to a maximum diameter of the bowl D2 is less than 0.17.

51. The piston of claim 50 wherein the ratio of the annular surface R1 to the maximum diameter of the bowl D2 is substantially 0.027.

52. The piston of claim 34 wherein the ratio of an annular surface R2 to a maximum diameter of the bowl D2 is between 0.01 and 0.15.

53. The piston of claim 52 wherein the ratio of the annular surface R2 to the maximum diameter of the bowl D2 is substantially 0.025.

54. The piston of claim 34 wherein the ratio of a bowl depth H1 to a maximum bowl diameter D2 is between 0.21 and 0.55.

55. The piston of claim 54 wherein the ratio of the bowl depth H1 to the maximum bowl diameter D2 is preferably substantially 0.315.

56. The piston of claim 34 wherein a ratio of the height of a bowl post H2 to a maximum bowl diameter D2 is between 0.11 and 0.46.

57. The piston of claim 56 wherein the ratio of the bowl post height H2 to the maximum bowl diameter D2 is preferably substantially 0.216.

58. The piston of claim 34 wherein a ratio of the radius of the spherical surface RS1 to a maximum bowl diameter D2 is between 0.11 and 0.59.

59. The piston of claim 58 wherein the ratio of the radius of the spherical surface RS1 to the maximum bowl diameter D2 is preferably substantially 0.392.

60. The piston of claim 34 wherein the ratio of the radius of an annular surface R3 to a maximum bowl diameter D2 is between 0.05 and 0.34.

61. The piston of claim 60 wherein the ratio of the radius of the annular surface R3 to the maximum bowl diameter D2 is preferably substantially 0.124.

62. The piston of claim 34 wherein the ratio of a radius of an annular surface R4 to a maximum bowl diameter D2 is between 0.01 and 0.09.

63. The piston of claim 62 wherein the ratio of the radius of the annular surface R4 to the maximum bowl diameter D2 is preferably substantially 0.018.

64. The piston of claim 33 the combustion chamber having a central axis, the combustion chamber central axis being coincident with a piston central axis.

65. A method of defining a combustion chamber assembly for a diesel engine, comprising:

forming a combustion chamber as a bowl space in a piston;

intersecting the combustion chamber with a crown of the piston;

substantially defining the combustion chamber by three surfaces, a post being at least in part a spherical surface, a bottom and first side portion being an annular surface, and a second side portion being a tapered surface;

rounding an edge and intersecting the crown at the rounded edge; and forming at least three reentrancies entering the combustion chamber bowl space, each reentrancy defining a structural ring centered on a center axis of the combustion chamber having a radius that is less than adjacent chamber structure.

66. The method of claim 65, including forming the combustion chamber spherical surface as a convex combustion chamber center portion with an origin and a radius, disposing the origin of the spherical surface on a combustion chamber central axis;

forming the annular surface being concave with an origin and a radius and joining the annular surface to the post;

joining the tapered surface at a first end to the annular surface; and transitioning the tapered surface to the crown of the piston at a second end.

67. The method of claim 66 including disposing the center axis of the combustion chamber coaxial with a center axis of the piston.

68. The method of claim 65 including forming a first reentrancy proximate a first margin of the tapered surface, transitioning the tapered surface to the annular surface with a second reentrancy and transitioning the annular surface to the spherical post with a third reentrancy.

69. The method of claim 65 including forming the combustion chamber symmetrically about a combustion chamber axis.

* * * * *